United States Patent [19]

Pocanschi

[11] Patent Number: 4,514,942

[45] Date of Patent: May 7, 1985

[54] DAMPING INSTALLATION FOR EARTHQUAKE-ENDANGERED BUILDINGS

[76] Inventor: Adrian Pocanschi, Hauptmannreute 94, Stuttgart 1, Fed. Rep. of Germany

[21] Appl. No.: 452,241

[22] Filed: Dec. 22, 1982

[30] Foreign Application Priority Data

Dec. 23, 1981 [DE] Fed. Rep. of Germany ..... 3151011

[51] Int. Cl.[3] ..... E02D 27/34; E04B 1/98; E04H 9/02

[52] U.S. Cl. ..... 52/167; 52/1; 248/636

[58] Field of Search ..... 52/167, 1; 248/562, 248/563, 621, 634, 635, 636

[56] References Cited

U.S. PATENT DOCUMENTS

| | | | |
|---|---|---|---|
| 3,212,745 | 10/1965 | Lode | 52/167 |
| 3,232,015 | 2/1966 | Latham | 52/167 |
| 3,789,174 | 1/1974 | Barkan et al. | 52/167 |
| 3,794,277 | 2/1974 | Smedley et al. | 52/167 |
| 3,796,017 | 3/1974 | Meckler | 52/167 |
| 4,188,681 | 2/1980 | Tada et al. | 52/167 |
| 4,209,868 | 7/1980 | Tada et al. | 52/167 |
| 4,330,103 | 5/1982 | Thuries et al. | 52/167 |
| 4,363,149 | 12/1982 | Kondo et al. | 52/167 |

*Primary Examiner*—Donald G. Kelly
*Assistant Examiner*—Michael Safavi
*Attorney, Agent, or Firm*—William A. Drucker

[57] ABSTRACT

A damping installation for earthquake-endangered buildings providing for a vibration insulator between the foundation and the building.

5 Claims, 3 Drawing Figures

DAMPING INSTALLATION FOR EARTHQUAKE-ENDANGERED BUILDINGS

The invention relates to damping installations for earthquake-endangered buildings providing for a vibration insulator between the foundation and the building.

There are already various installations of this kind to conduct seismic insulation. Among others the concept of a horizontally gliding or three-dimensionally floating bearing was pursued, being also the subject matter of this invention. Here the fundamental idea was that the superstructure is a protected building section separated from the foundation and supported on all sides by highly elastic bearings of e.g. neoprene. The utilization of these bearings as seismic insulators has as yet, however, been limited on account of several unsolved problems.

In the course of time the insulation material gets worn out under the constant heavy load of the building and loses its damping properties. Therefore it is imperative that the bearings are replaced regularly. On this score the bearings were placed on wedges and the building slightly lifted by an air-cushion device so as to relieve the bearings when replacement is carried out.

In order to absorb wind power and to secure the stability of the building, special constructions are to be provided according to the state of engineering.

Since no firm vertical connection exists between the foundation and the superconstruction, the hitherto suggested insulators cannot be applied to tall buildings in danger of overturning.

The aim of this invention is to eliminate the aforesaid disadvantages and to improve the said damping installation to such a degree that the replacement of the vibration insulator is redundant during the entire length of its working life.

In order to solve this problem through the invention the distinghuishing features are provided according to claim 1. The result is that under normal conditions and provided there is no earthquake, the vibration insulator will bear no load or a neglibible load only. With the load falling away there is no wear and tear of the insulator so that replacement is redundant.

Moreover this invention surprisingly does not require special devices to cope with the wind power when securing the stability of the building.

Furthermore this invention now allows for tall buildings to be damped laterally too, because under normal conditions, the danger of overturning is eliminated by the firm connection between the foundation and the superstructure.

Additional advantages and details of the invention are apparent from the following description of some embodiments thereof as shown in the drawing. Here:

Figure 1:
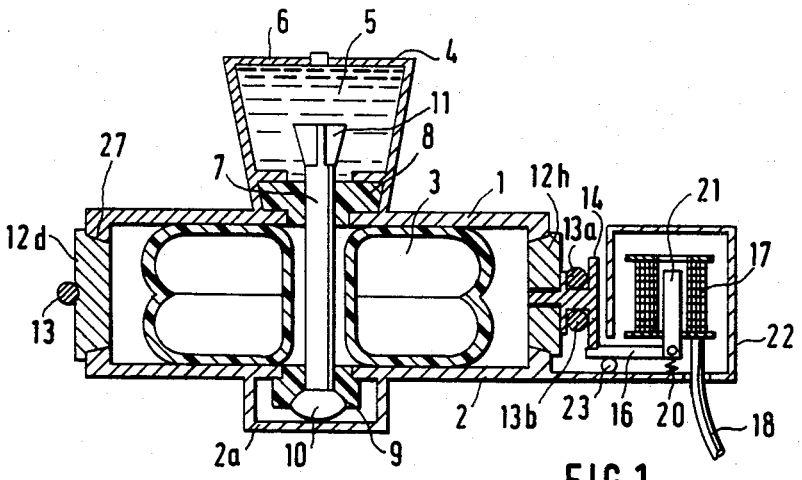
FIG. 1 shows a vertical section through the damping absorber installation with trip mechanism according to the invention.

FIG. 1 shows the casing with a top section 1 and a bottom section 2 connected in the vertical sides by the spacer wedges 12*a* to 12*h*. Inside the casing the vibration insulator 3 is arranged between the slab-shaped sections 1 and 2, being either an air-spring or a rubber-spring. In the centre of the top section of the casing the container 4 is visible, filled with viscous liquid 5 and locked on top by a membrane 6. The damping post 7 can be seen in the centre of the casing, the elongated end reaching into the upper container 4 and provided with a wing head 11. The bottom end of the post 7 is furnished with a snap head 10 and flexibly installed in the lowest section of 2*a* of the bottom casing 2. To ensure a firm connection between the post 7 and the casing, a neoprene insulation 8 is featured in the top casing below the wing head 11. In the bottom section around the head 10, the post 7 is jacketed with a neoprene shockabsorber located in the lowest section of 2*a* of the casing.

Figure 3:
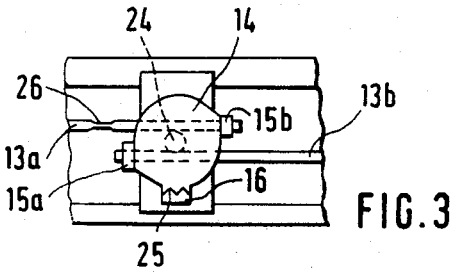
FIG. 3 shows a part view of a detail of the installation according to FIGS. 1 and 2.

FIG. 1 shows the spacer wedge 12*d* left and 12*a* right at the extreme edge of the casing, transmitting the force from the top section 1 to the bottom section 2, provided there are normal conditions. They are connected by the spacer ring 13. The two ends 13*a*, 13*b* of the ring 13 penetrate the sheave 14 which in turn is pivoted on a wedge as shown in FIG. 3, and which are anchored by a fixing method 15*a*, 15*b*.

More to the right FIG. 1 shows a casing 22 to embody an electro magnet 17, containing a flexible anchor 21 kept in position by a spring 20, as shown. There is a flexible connection between the lever 16 and the anchor 21, the lever acting over a support 23 into the said sheave 14. Inside the sheave the two ends 13*a* and 13*b* of the ring can be seen.

Figure 2:
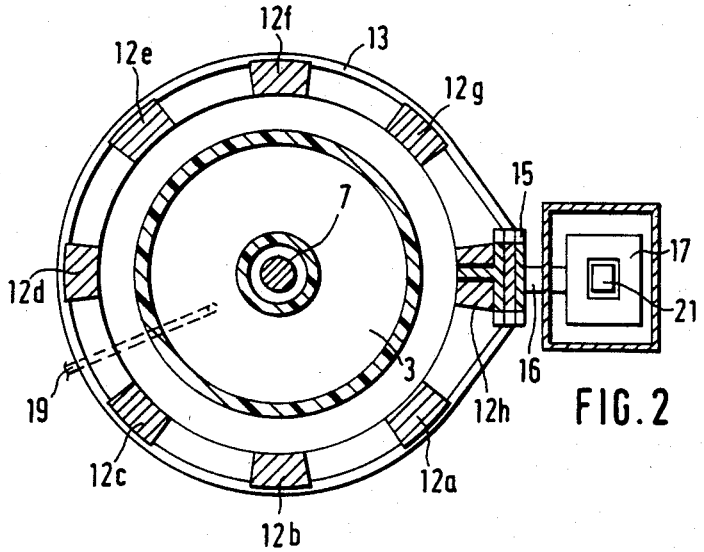
FIG. 2 shows a horizontal section through the installation according to FIG. 1 schematically.

FIG. 2 shows the sectional plan view of the installation according to FIG. 1. It will be noticed that a greater number of spacer wedges 12*a* to 12*h* are arranged between top and bottom section. It is also a section through the closure ring 13 that keeps the wedges in position.

The vibration insulator 3 is a familiar rubber or air-cushion bearing, so that a more detailed description is redundant. FIG. 3 shows the said sheave 14 with grooves on top and at the bottom where the two ends 13*a* and 13*b* of the closure ring 13 are attached by the fixing elements 15*a* and 15*b*. The lateral grooves are arranged above and below the axis 24 of the roller 14. As the ring 13 is exposed to tension, the sheave 14 is strained by a left torsion, but blocked by the lever 16 arrested in the notches 25 of the roller. As soon as the end of the lever 16 in FIG. 3 is admitted downwards by the electro magnet 17 over the lever 16 the sheave is released, so that the closure ring 13 breaks at the plane of weakness 26, whereupon the wedges 12*a* to 12*h* slip outward.

In the following the mechanism of the invention is described in detail:

Mention has already been made that the release of the torque of the sheave 14 is guaranteed by the disengaging joint 16, without utilizing the plane of weakness. The disengaging joint has the shape of a transmission lever whose support 23, as shown in FIG. 1, is stabilized at the bottom section. Its longer arm is fastened to the return spring 20. The electro magnet 17 is being supplied with power by a connection cable the very second that the earthquake occurs.

The second release method is launched by the auto-release of the closure ring 13 as soon as the transmitted power exceeds a given limit. This additional safety measure is guaranteed by the plane of weakness 26 which actually represents the reduction of the annular section. At this point the ring abruptly breaks under a certain known amount of power. Such forces are, of course, encountered as a result of earthquake vibrations.

The incline 27 of the wedges 12 according to FIG. 1 is enough to secure against self-locking. Immediately after the ring 13 has been detached, the full gravity of the top section 1 presses down on the bottom section 2, thereby loading and compressing the insulator 3 in such a way that it is squeezed outward in both directions from between the sections of the casing. As the load is exercised by jerks, a supplementary damping post 7 was installed. At this rests with its head 10 on the casing section 2*a*, the wing head 11 is pressed upwards into the viscous liquid 5. Due to the neoprene insulation 8, the liquid cannot escape. The liquid may give way to some extent through the membrane 6. Additional damping also ensues from the lower head 10 by the neoprene shock absorber 9. In this way the thrust is cushioned until the insulator takes over the full static loading.

The operation of the vibration insulator 3 may be adjusted by the oil pressure, for instance. For this purpose, the enclosed space shown in FIG. 1 could be supplied through a conduit 19 with a valve not shown in the figure. It is a safety valve opening only at a given pressure, thus securing that further yield can only occur when a given pressure is exceeded. In this way the thrust may be dampened as required. Moreover, a given pressure may be maintained in the space 3 in advance, so that a considerable force is present to meet the thrust right away.

According to another method of execution, the wedges 12*a* and 12*h* can be replaced by particularly brittle parts. This may involve cube-shaped elements that break under a horizontal earth shock. Experts are familiar with brittle material suited for this purpose. More details are therefore redundant.

The insulation of a building necessitates a certain amount of such damping installations. Their number depends on the assumed supporting capacity and the degree of insulation of an installation unit.

The damping devices are to be inserted into the joints between the foundation and the superstructure, in order that the bottom casing or the baseplate may reset on the foundation, while the top casing is fixed to the superstructure. The ring 13 is designed so as to transmit the maximum wind power to the foundation and to yield abruptly when this pressure is exceeded.

In the event of an earthquake, the receiver positioned in the vicinity of the building will receive the first relevant signals and thereby closing the circuit.

If the operation of the release mechanism malfunctions or is aborted altogether by unknown causes, the auto trip mechanism takes effect. The movement of the foundation produces inertia forces. If these forces reach a precalculated limit, the ring 13 will yield.

The operation of the damping post 17 also comprises the limitations of deflections of buildings that occur during earthquakes, thus preventing overturning of the superstructure and damping the vibrations produced by the ensueing dynamic frictional forces in the liquid.

After the earthquake the superstructure may be lifted by the familiar air-cushion device and the damping installation may be repaired without the necessity to replace the vibration insulator 3 in this particular instance.

According to yet another method of execution not shown in the drawing, the said connection element between the top section 1 and the bottom section 2 embodies a detonation chamber with an explosive. It is connected to an electric detonator to be triggered off in the said manner. It involves an explosive with electrical detonator built into a fixing element 15, for example. In this case the explosion is triggered off by closing the circuit and the fixing element is destroyed and the ring 13 is detached. Systems of this kind are principally known so that a detailed description is redundant.

I claim:

1. Damping installation for earthquake-endangered buildings where a vabration insulator is arranged between the foundation and the building showing that the vibration insulator rests in an overall casing consisting of a top casing and a bottom casing through which, under normal conditions, i.e. excluding earthquakes, the gravity of the building is transmitted mainly through a rigid connection of minor load to the vibration insulator and that the connection between the top and bottom section severs in an earthquake, thereby loading the vibration insulator wherein the detachable connection is formed by spacer wedges in the vertical sections of the casing which, under normal conditions, are held in position by a closure ring, the ring having a plane of weakness breaking by the agency of an earthquake.

2. Damping installation according to claim 1, whereby a damping post is arranged between the top section and the bottom section featuring reinforcements above and below which each in itself are surrounded by damping material in the top as well as the bottom section, wherein the upper reinforcement of the damping post is featured as a wing head arranged in a viscous liquid in a container in the top section.

3. Damping installation according to claim 2, wherein a neoprene damping is arranged in a viscous liquid in the bottom section of the container.

4. Damping installation for earthquake-endangered buildings, where a vibration insulator is arranged between the foundation and the building showing that the vibration insulator rests in an overall casing consisting of a top casing and a bottom casing through which, under normal conditions, i.e., excluding earthquakes, the gravity of the building is transmitted mainly through a rigid connection of minor load to the vibration insulator and that the connection, which is held by a ring between the top and bottom section severs in an earthquake after rupture of the ring, thereby loading the vibration insulator, wherein the detachable connection is made up of brittle parts which break by the agency of an earthquake, wherein the rupture of the ring is set off by an electromagnet along a lever, the electrical impulse being transmitted by a seismograph.

5. Damping installation according to claim 4 wherein a roller featured with grooves to receive the respective ends of the ring is attached to where the lever acts.

* * * * *